United States Patent [19]

Suzuki et al.

[11] Patent Number: 4,884,623

[45] Date of Patent: Dec. 5, 1989

[54] METHOD FOR PRODUCING A GAP SPACER FOR MAGNETIC HEADS

[75] Inventors: Kunio Suzuki; Masayuki Takamura; Tadashi Kubono, all of Shizuoka, Japan

[73] Assignee: Yamaha Corp., Japan

[21] Appl. No.: 281,813

[22] Filed: Dec. 8, 1988

[30] Foreign Application Priority Data

Dec. 9, 1987 [JP] Japan ..... 62-312649

[51] Int. Cl.[4] ..... B22D 23/00

[52] U.S. Cl. ..... 164/129; 29/424; 29/603; 164/131; 427/250; 427/272; 427/282

[58] Field of Search ..... 29/424, 603; 264/308, 264/313, 317, 298.7; 427/404–406, 282, 272; 164/129, 131

[56] References Cited

U.S. PATENT DOCUMENTS

| | | | |
|---|---|---|---|
| 1,646,297 | 10/1927 | Lindsay | 264/317 X |
| 2,384,229 | 9/1945 | Ammann | 164/129 X |
| 3,891,735 | 6/1975 | North et al. | 264/298.7 |

*Primary Examiner*—Carl E. Hall

*Attorney, Agent, or Firm*—Ostrolenk, Faber, Gerb & Soffen

[57] ABSTRACT

In production of a gap spacer for magnetic heads in electric and electronic appliances, accumulation of a non-magnetic material insoluble to acids or alkalis on a thin base soluble to these solvents is employed with use of a proper mask as a substitute for the conventional rolling process. Stable growth in thickness of the non-magnetic material during the accumulation process assures highly precise thickness uniformity of the product via easy time control of the process and absence of the rolling process allows broader freedom in choice of the material.

11 Claims, 3 Drawing Sheets

METHOD FOR PRODUCING A GAP SPACER FOR MAGNETIC HEADS

BACKGROUND OF THE INVENTION

The present invention relates to an improved method for producing a gap spacer for magnetic heads, and more particularly relates to a method which produces a non-magnetic gap spacer having a controlled and uniform thickness.

Magnetic heads used in electric and electronic appliances are generally made up of a ring-shaped core and a coil wound around the core. In the case of a stereo set, for example, a pair of heads carried by a core holder are encased within a shield housing. The ring-shaped core has a small radial gap defined by a pair of mating ends and a gap spacer is inserted in the gap in tight contact with the mating ends.

In the production of a permalloy or sendust head, a non-magnetic wafer of a several micron thickness is clamped between a pair of mating ends after polishing and lapping of the latter to provide a gap spacer. In the case of a ferrite head, a thin glass plate sandwiched by a pair of ferrite blocks is heated at a temperature of several hundred degrees for formation of a gap spacer via chemical bonding between the glass and ferrite materials.

Conventionally, production of the non-magnetic wafer and the thin glass plate was carried out by rolling to a raw material. In practice, however, it is very difficult with the conventionally used materials to successfully produce a wafer or the thin plate having a uniform thickness of 1.5 m by means of rolling. This difficulty in producing plates by rolling sharply reduced materials which could successfully be used.

SUMMARY OF THE INVENTION

It is the object of the present invention to produce a gap spacer for magnetic heads with highly precise thickness uniformity and broader freedom in choice of the material.

In accordance with the basic aspect of the present invention, a gap spacer is developed on a thin base via accumulation of a non-magnetic material.

DESCRIPTION OF THE PREFERRED EMBODIMENTS

Figure 1A:
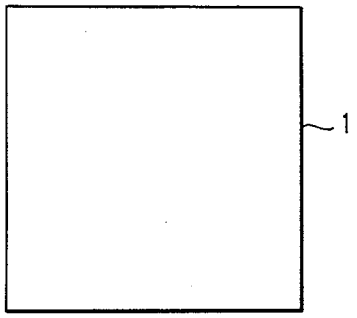
FIGS. 1A and 1B are plan and sectional side views of a thin base used for an Example of the present invention.

As briefly stated, the process of the present invention includes the step of accumulating a non-magnetic material on a plate like thin base. More specifically, a mask of a prescribed pattern is first deposited on a thin base made of a material which is soluble in a specific acid or alkali, a non-magnetic material which is insoluble in said specific acid or alkali is then accumulated on the thin base (and on the mask), the mask (and with it the non-magnetic material deposited on the mask) is removed from the thin base and finally the thin base is removed from the remaining non-magnetic material via solution by said specific acid or alkali to form a wafer of non-magnetic material which can be used as a gap spacer.

The thin base is usually made of metal such as copper, nickel and aluminum because of its high workability and the ease with which it can be dissolved by acids or alkalis. Although there is not a distinct preferable range for the thickness of the base, the thinner the base the sooner it will dissolve.

After cleansing of the surface of the thin base, a mask of a selected thickness is deposited on the thin base in close contact with the surface of the base. For example, the mask may be provided with several windows 2 mm×2 mm in dimension. An emulsion mask or a hard mask is used for this deposition.

Next, a non-magnetic material which is insoluble to acids or alkalis is accumulated to a prescribed thickness on the thin base covering the mask. Accumulation of the non-magnetic material is effected by means of vacuum evaporation (vacuum deposition), ion deposition, CVD (Chemical Vapor deposition) process or sputtering process. Preferably, the thickness of the accumulation should be in a range from 0.5 to 3.0 μm. Titanium, molybdenum, tungsten, zirconium, alloys of these elements, carbides of these elements, oxides of these elements and nitrides of these elements are generally used as the non-magnetic material.

After complete accumulation of the non-magnetic material, the mask and with it the portion of the non-magnetic material formed on the mask is peeled off from the thin base. As a result, the portion of the non-magnetic material which was directly deposited on the thin base through the windows in the mask remains on the surface of the thin base.

Finally, the thin base is removed from the remaining non-magnetic material via solution with acids or alkalis in order to obtain non-magnetic wafers having a prescribed thickness. Different acids or alkalis are used for different thin base materials. The particular acids or alkalis to be used can be selected with reference to Table 1 which shows the solubility of various materials to acids and alkalis.

TABLE 1

| | Thin base | | | Non-magnetic material | | | | |
|---|---|---|---|---|---|---|---|---|
| | Cu | Al | Ni | Ti | Mo | W | Zr | $SiO_2$ |
| Acid | | | | | | | | |
| HCl | X | O | X | Δ/O hot | X | X | Δ | X |
| $HNO_3$ | O | O/X conc. | O/X conc. | Δ/O conc. hot | Δ/O conc. | X | Δ | X |
| $H_2SO_4$ | O conc. hot | O | X | Δ/O hot | Δ/O conc. hot | X/Δ dil hot | Δ/O conc. hot | X |
| Alkali | | | | | | | | |
| KOH | X | O | X | X | — | Δdil cold O conc. hot | X | O |
| NaOH | X | O | X | X | — | Δ | X | O |

Conc; concentrated state
dil; diluted state
hot; hot state
cold; cold state

In the Table O indicates "soluble", Δ indicates "slightly soluble" and X indicates "insoluble".

In accordance with the present invention, formation of a non-magnetic wafer for a gap spacer is effected by accumulation of non-magnetic material on a thin base. As is well known, the thickness of the material increases in a very stable manner when deposited by an accumulation process. The thickness of the material accumulated is almost solely dependent upon the length time period during which the process is carried out. Since measurement of time can be generally carried out very easily and precisely, the length of process period can be controlled very precisely, thereby assuring highly precise thickness uniformity of the product. Since the production process avoids the use of rolling, a wider variety of materials may be used during production, the materials used being dependent on their solubility to acids or alkalis.

EXAMPLE

Figure 1B:
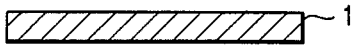

A rectangular, metallic thin base 1 was prepared as shown in FIGS. 1A and 1B. For solution by acid or alkali etching, an aluminum or nickel plate of 0.03 to 0.05 mm thickness was used. As is well known, metallic material is well suited for solution in an etching bath.

Next, a mask 3 was prepared. This mask 3 had a contour which was the same as that of the thin base 1. The thickness of the mask 3 wasn't directly related to that of the product, i.e. the gap spacer, and was chosen as a function of various process conditions. The mask 3 was preferably made of metal or ceramics so that it would well endure heat generated during the accumulation of the non-magnetic material. Several windows 5 of a prescribed pattern were formed in the mask 5. In the example, rectangular windows of 2 mm×4 mm were employed.

Figure 2A:
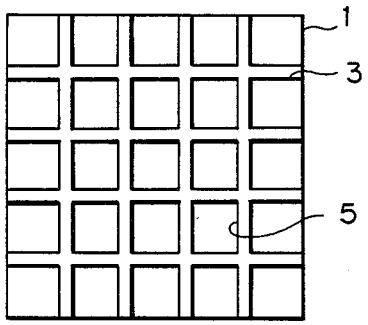
FIGS. 2A and 2B are plan and sectional side views of a mask deposited on the thin base.
Figure 2B:
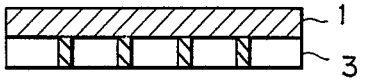

Next, the mask 3 was deposited on the thin base 1 in tight contact with the surface of the base 1 after cleansing of the surface of the base 1 as shown in FIGS. 2A and 2B. Thus, the surface of the thin base 1 was locally covered by the latticework configuration of the mask 3 and locally exposed through the rectangular windows 5 in the mask 3.

Figure 3A:
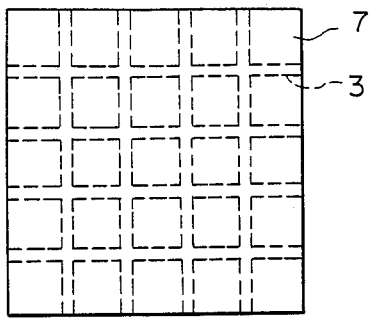
FIGS. 3A and 3B are plan and sectional side views of accumulation process in the Example.
Figure 3B:
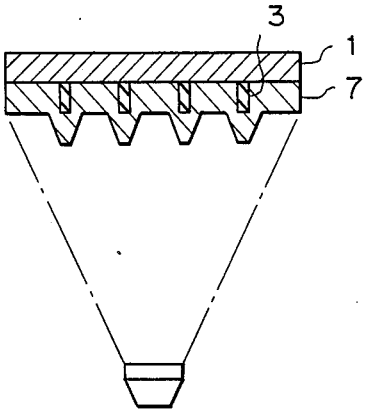

As shown in FIGS. 3A and 3B, titanium was accumulated on the thin base 1 and the mask 3 by means of vacuum evaporation in order to form a non-magnetic wafer 7 of 1.5 μm thickness.

Figure 4A:
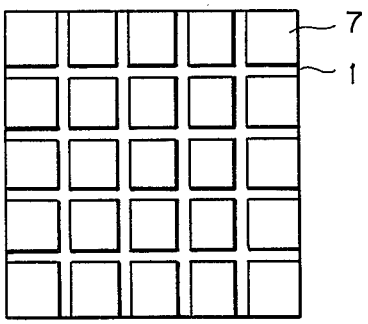
FIGS. 4A and 4B are plan and sectional side views of the thin base after removal of the mask.
Figure 4B:
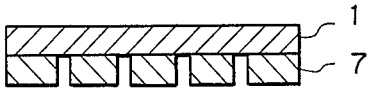

After complete formation of the non-magnetic wafer 7, the mask 3 was peeled off from the thin base 1 to obtain a structure shown in FIGS. 4A and 4B in which a plurality of non-magnetic wafers 7 corresponding in pattern and number to the windows 5 were left on the thin base 1.

Figure 5A:
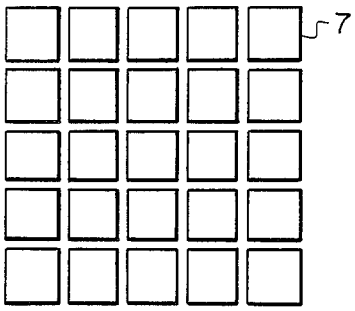
FIGS. 5A and 5B are plan and sectional side views of non-magnetic wafers produced in the Example.
Figure 5B:
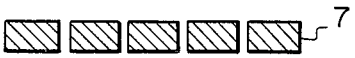

Finally, the combination was subjected to etching with acid or alkali for solution of (to dissolve) the thin base 1. As show in FIGS. 5A and 5B, a plurality of non-magnetic wafers 7 of 1.50 μm thickness were concurrently produced. As seen in Table 2, the thickness of the products were highly uniformity as compared with the conventional products produced by means of rolling.

TABLE 2

| Variation in thickness | |
|---|---|
| Conventional product (Rolling) | Product of the invention (Accumulation) |
| 1.5 ± 0.15 μm | 1.5 ± 0.05 μm |

We claim:

1. A method for producing a gap spacer for magnetic heads, said method comprising the steps of:

preparing a thin base which is soluble in a specific acid or alkali;

depositing a mask of a prescribed pattern on said thin base in tight surface contact with said thin base;

accumulating a non-magnetic material which is insoluble to said specific acid or alkali on both said thin base and said mask;

removing said mask from said thin base so as to create a plurality of gap spacers of said non-magnetic material on said thin base; and removing said thin base from said non-magnetic material via solution with said specific acid or alkali so as to create a plurality of non-connected gap spacers.

2. An method as claimed in claim 1 in which a metallic material is used for said thin base.

3. A method as claimed in claim 2 in which said metallic material is chosen from a group consisting of Cu, Al and Ni.

4. A method as claimed in claim 1 in which said mask is mechanically removed from said thin base.

5. A method as claimed in claim 1 in which said mask has a latticework configuration defining a plurality of windows.

6. A method as claimed in claim 1 in which said non-magnetic material is chosen from a group consisting of titanium, molybdenum, tungsten, zirconium, alloys of these elements, carbides of these elements, oxides of these elements and nitrides of these elements.

7. A method as claimed in claim 1 in which said non-magnetic material is $SiO_2$.

8. A method as claimed in claim 1 in which said non-magnetic material is accumulated to a thickness in a range from 0.5 to 3.0 μm.

9. A method as claimed in claim 1, wherein said mask is completely removed from said thin base during said mask removing step.

10. A method as claimed in claim 9, wherein said thin base is completely removed from said non-magnetic material during said thin base removing step.

11. A method as claimed in claim 1, wherein said thin base is completely removed from said non-magnetic material during said thin base removing step.

* * * * *